US010934986B1

(12) United States Patent
Stewart et al.

(10) Patent No.: US 10,934,986 B1
(45) Date of Patent: Mar. 2, 2021

(54) FUEL DELIVERY SYSTEM

(71) Applicants: DENSO International America, Inc., Southfield, MI (US); Denso Corporation, Kariya (JP)

(72) Inventors: Garrett Stewart, Fenton, MI (US); Steve Roseborsky, Kingsville (CA)

(73) Assignees: DENSO International America, Inc., Southfield, MI (US); DENSO Corporation, Kariya (JP)

( * ) Notice: Subject to any disclaimer, the term of this patent is extended or adjusted under 35 U.S.C. 154(b) by 0 days.

(21) Appl. No.: 16/707,811

(22) Filed: Dec. 9, 2019

(51) Int. Cl.
*F02M 61/14* (2006.01)
*F02M 55/02* (2006.01)

(52) U.S. Cl.
CPC ..... *F02M 61/14* (2013.01); *F02M 55/02* (2013.01); *F02M 2200/853* (2013.01); *F02M 2200/856* (2013.01); *F02M 2200/857* (2013.01); *F02M 2200/858* (2013.01)

(58) Field of Classification Search
CPC .. F02M 61/14; F02M 55/02; F02M 2200/853; F02M 2200/856; F02M 2200/857; F02M 2200/858
USPC ..... 123/470
See application file for complete search history.

(56) References Cited

U.S. PATENT DOCUMENTS

| | | | | |
|---|---|---|---|---|
| 9,938,948 | B2 | 4/2018 | Serra et al. | |
| 10,267,280 | B2 | 4/2019 | Pasquali et al. | |
| 2010/0218743 | A1* | 9/2010 | Marc | F02M 61/168 123/470 |
| 2018/0372045 | A1* | 12/2018 | Oh | F02M 61/168 |

FOREIGN PATENT DOCUMENTS

| | | | |
|---|---|---|---|
| JP | 2010168965 | A * | 8/2010 |
| JP | 5126083 | B2 | 1/2013 |
| JP | 2013050109 | A * | 3/2013 |

OTHER PUBLICATIONS

JP20130501109A (Sugiura et al.) Mar. 14, 2013 (machine translation) [online] (retrieved on Sep. 17, 2020] retrieved from EPO website. (Year: 2013).*

* cited by examiner

*Primary Examiner* — Mahmoud Gimie
(74) *Attorney, Agent, or Firm* — Brooks Kushman P.C.

(57) ABSTRACT

A fuel delivery system for an engine includes a fuel rail cup, a fuel injector, and a retainer clip. The fuel rail cup extends along a longitudinal axis and defines an opening that extends radially outward from the longitudinal axis. The fuel injector has an upper end that is disposed within the opening such that the cup and fuel injector are aligned along the longitudinal axis. The retainer clip has a central body and at least one prong that protrudes upward from the central body. The central body engages the fuel injector and the at least one prong engages the fuel rail cup such that the clip inhibits axial movement of the fuel injector relative to the fuel rail cup along the longitudinal axis and such that the clip inhibits rotation of the fuel injector relative to the fuel rail cup about the longitudinal axis.

15 Claims, 3 Drawing Sheets

FUEL DELIVERY SYSTEM

TECHNICAL FIELD

The present disclosure relates to fuel delivery systems for internal combustion engines.

BACKGROUND

Internal combustion engines include fuel delivery systems that are configured to transport fuel from a storage container, such as a fuel tank, to the individual cylinders of the internal combustion engine.

SUMMARY

A fuel delivery system for an engine includes a fuel rail cup, a fuel injector, and a retainer clip. The fuel rail cup extends along a longitudinal axis and defines an opening that extends radially outward from the longitudinal axis. The fuel injector has an upper end that is disposed within the opening such that the cup and fuel injector are aligned along the longitudinal axis. The retainer clip has a central body and at least one prong that protrudes upward from the central body. The central body engages the fuel injector and the at least one prong engages the fuel rail cup such that the clip inhibits axial movement of the fuel injector relative to the fuel rail cup along the longitudinal axis and such that the clip inhibits rotation of the fuel injector relative to the fuel rail cup about the longitudinal axis.

A fuel delivery system for an engine includes a fuel rail cup, a fuel injector, and a retainer clip. The fuel rail cup extends along a longitudinal axis, defines an opening that extends radially outward from the longitudinal axis, and has a ridge that protrudes radially outward from a lower end of the fuel rail cup. The ridge defines an exterior notch. The fuel injector has an upper end that is disposed within the opening such that the cup and fuel injector are aligned along the longitudinal axis. The retainer clip has a central body. The retainer clip also has first and second prongs that protrude upward from the central body. The central body is secured to the fuel injector such that axial movement of the clip and rotation of the clip relative to the fuel injector along and about the longitudinal axis, respectively, are inhibited. The first prong has a first J-hook that engages the ridge to inhibit axial movement of the clip relative to the fuel rail cup along the longitudinal axis. The second prong extends upward, into the notch, and engages the ridge within the notch to inhibit rotation of the clip relative to the fuel rail cup about the longitudinal axis.

A fuel delivery system for an engine includes a fuel rail cup, a fuel injector, and a retainer clip. The fuel rail cup extends along a longitudinal axis, defines an opening that extends radially outward from the longitudinal axis, has a ridge that protrudes radially outward from a lower end of the fuel rail cup, defines a notch between a top surface of the ridge and an overhanging surface, and has a flat surface that partially defines the notch and faces radially outward relative to the longitudinal axis. The fuel injector has an upper end that is disposed within the opening such that the cup and fuel injector are aligned along the longitudinal axis. The retainer clip has a central body and a prong that protrudes upward from the central body. The central body is secured to the fuel injector such that axial movement of the clip and rotation of the clip relative to the fuel injector along and about the longitudinal axis, respectively, are inhibited. The prong extends upward and engages the overhanging surface. The prong extends downward from the overhanging surface and engages the top surface of the ridge to inhibit axial movement of the clip relative to the fuel rail cup along the longitudinal axis. The prong also engages the flat surface to inhibit rotation of the clip relative to the fuel rail cup about the longitudinal axis.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
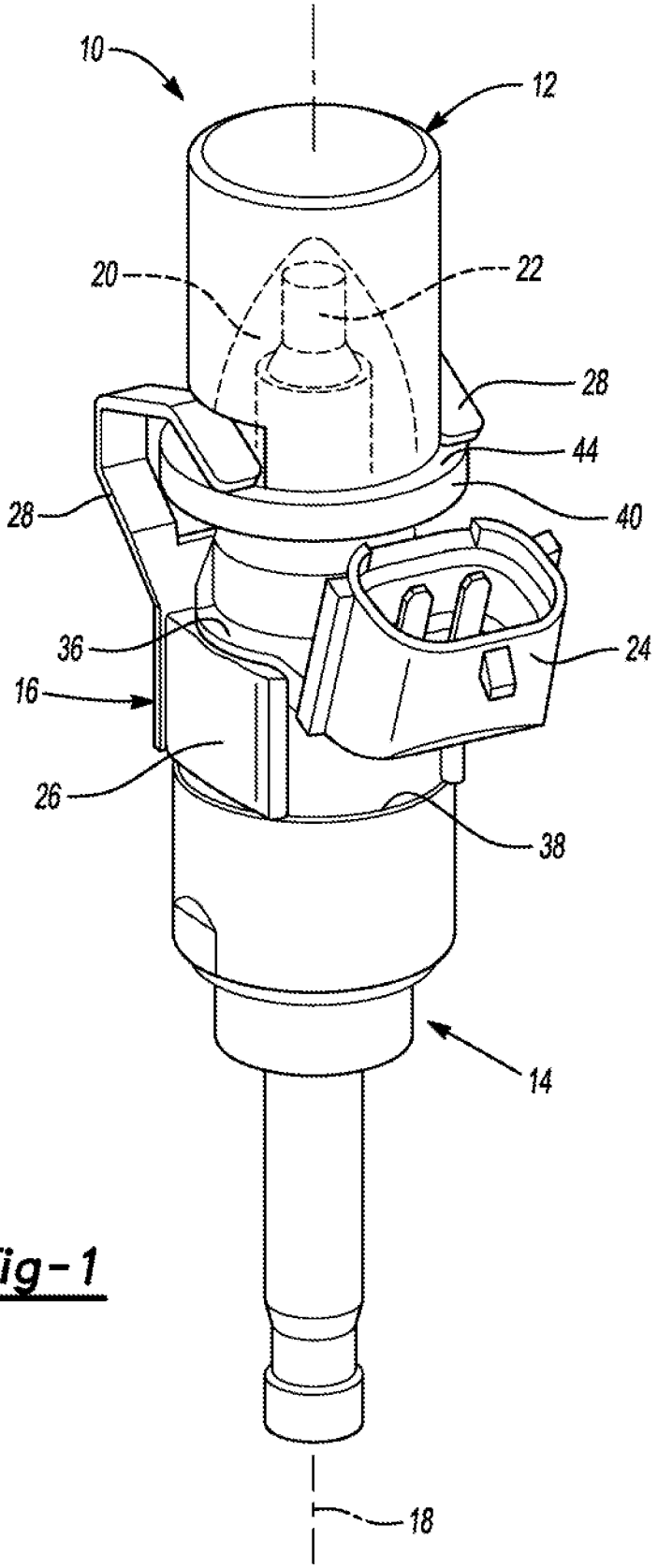
FIG. 1 is an isometric view of a first embodiment of a fuel delivery system that includes a fuel rail cup, a fuel injector, and a first embodiment of a clip that secures the fuel injector to the fuel rail cup.
Figure 2:
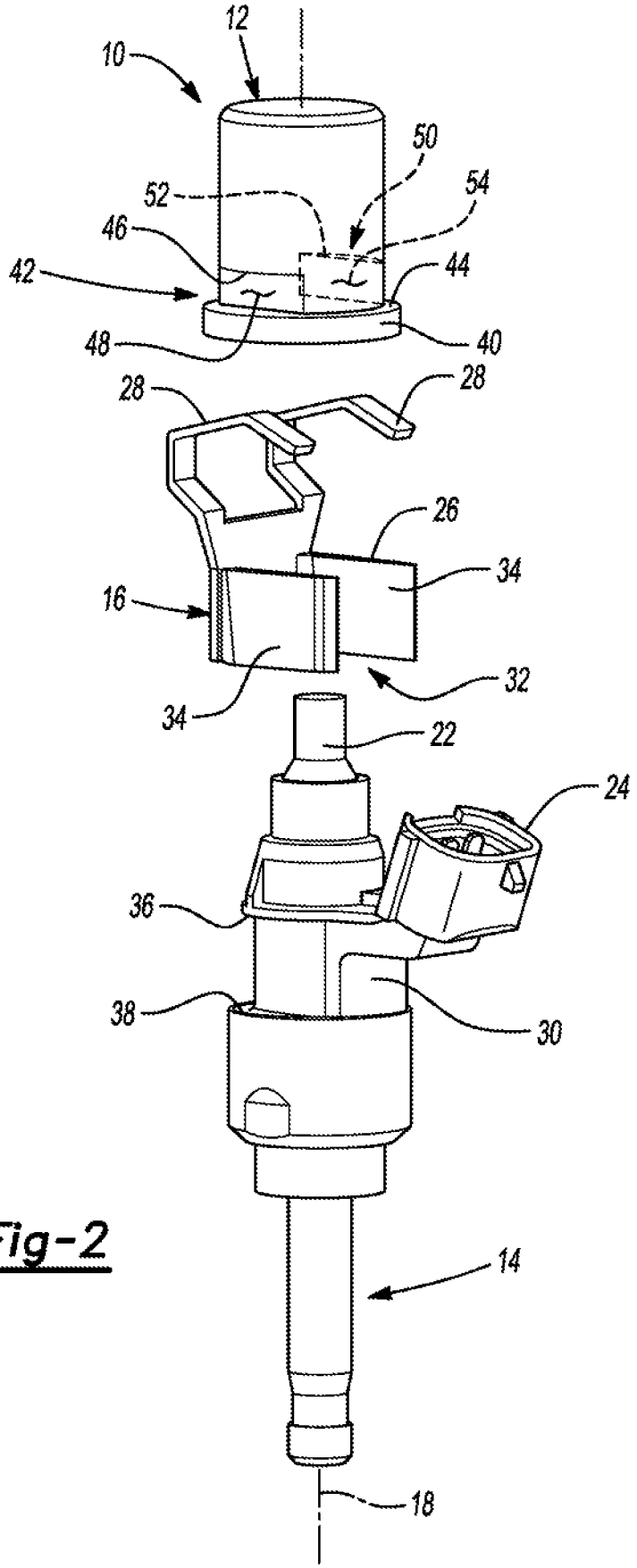
FIG. 2 is an exploded view of the first embodiment of the fuel delivery system.

Referring to FIGS. 1 and 2, a first embodiment of a fuel delivery system 10 for an engine that includes a fuel rail cup 12, a fuel injector 14, and a first embodiment of a retainer clip 16 that secures the fuel injector 14 to the fuel rail cup 12 is illustrated. The fuel rail cup 12 extends along a longitudinal axis 18 and defines an opening 20 that is configured to receive an upper end 22 of the fuel injector 14. Stated in other terms, the fuel injector 14 may be configured to engage the fuel rail cup 12 such that the upper end 22 of the fuel injector 14 is disposed within the opening 20 and such that the fuel rail cup 12 and the fuel injector 14 are axially aligned along the longitudinal axis 18. The fuel injector 14 may include an electrical receptacle 24 that protrudes outward from the fuel injector 14. More specifically, the electrical receptacle 24 may protrude radially outward from the fuel injector 14. The electrical receptacle 24 of the fuel injector 14 may connect the fuel injector 14 to an external power source and an external controller that is configured to operate an electrical solenoid within the fuel injector 14 in order to open and close the fuel injector 14 for the purpose of delivering fuel to a respective cylinder of an internal combustion engine that the fuel injector 14 is configured to deliver fuel to.

The retainer clip 16 has a central body 26 and at least one prong 28 that protrudes upward from the central body 26. The embodiment depicted in FIGS. 1 and 2 has two prongs 28. The central body 26 engages the fuel injector 14 and the prongs 28 engage the fuel rail cup 12 such that the retainer clip 16 prevents or inhibits axial movement of the fuel injector 14 relative to the fuel rail cup 12 along the longitudinal axis 18. The central body 26 also engages the fuel injector 14 and the prongs 28 also engage the fuel rail cup 12 such that such that the retainer clip 16 prevents or inhibits rotation of the fuel injector 14 relative to the fuel rail cup 12 about the longitudinal axis 18. The prongs 28 may also be configured to generate a biasing force on the fuel rail cup 12 to absorb combustion energy that is translated to the fuel injector 14 during combustion within the engine.

The fuel injector 14 has one or more exterior surfaces 30. The central body 26 of the retainer clip 16 defines a slot 32. More specifically, the central body 26 may include a pair of plates 34 that define the slot 32. The retainer clip 16 engages the one or more exterior surfaces 30 of the fuel injector 14 along the slot 32 such that rotation of the retainer clip 16 relative to the fuel injector 14 about the longitudinal axis 18 is prevented or inhibited. More specifically, the one or more exterior surfaces 30 of the fuel injector 14 may comprise a pair of substantially parallel exterior surfaces 30. Substantially parallel may refer to any incremental value between exactly parallel and 15° from exactly parallel. More specifically, the slot 32 may be rectangular in shape, the pair of plates 34 that define the slot 32 may be substantially parallel to each other, and the pair of substantially parallel plates 34 of retainer clip 16 may engage the pair of substantially parallel exterior surfaces 30 along the rectangular slot 32 such that rotation of the retainer clip 16 relative to the fuel injector 14 about the longitudinal axis 18 is prevented or inhibited.

The fuel injector 14 has an upper ridge 36 and a lower ridge 38 that protrude radially outward from the fuel injector 14 relative to the longitudinal axis 18. The one or more exterior surfaces 30, or more specifically the pair of substantially parallel exterior surfaces 30, are disposed between the upper ridge 36 and the lower ridge 38. The central body 16, or more specifically the pair of plates 34 that define the slot 32, is disposed between or sandwiched between the upper ridge 36 and the lower ridge 38 such that axial movement of the retainer clip 16 relative to the fuel injector 14 along the longitudinal axis 18 is prevented or inhibited. Stated in other terms, when the retainer clip 16 is secured to the fuel injector 14, the upper ridge 36 overhangs the central body 16, or more specifically the pair of plates 34 that define the slot 32 overhang the central body 16, such that upward movement of the retainer clip 16 relative to the fuel injector 14 is prevented or inhibited and the central body 16, or more specifically the pair of plates 34, overhangs the lower ridge 38 such that downward movement of the retainer clip 16 relative to the fuel injector 14 is prevented or inhibited.

The fuel rail cup 12 has a ridge 40 that protrudes radially outward from a lower end of the fuel rail cup 12. The fuel rail cup 12 defines a first notch 42 between a top surface 44 of the ridge 40 and a first overhanging surface 46. A first of the prongs 28 extends upward and engages the first overhanging surface 46. The first of the prongs 28 then extends downward from the first overhanging surface 46 and engages the top surface 44 of the ridge 40 to prevent or inhibit axial movement of the retainer clip 16 relative to the fuel rail cup 12 along the longitudinal axis 18. The fuel rail cup 12 has a first flat surface 48 that partially defines the first notch 42 and faces radially outward relative to the longitudinal axis 18. The first of the prongs 28 engages the first flat surface 48 to prevent or inhibit rotation of the retainer clip 16 relative to the fuel rail cup 12 about the longitudinal axis 18.

The fuel rail cup 12 defines a second notch 50 between the top surface 44 of the ridge 40 and a second overhanging surface 52. A second of the prongs 28 extends upward and engages the second overhanging surface 52. The second of the prongs 28 then extends downward from the second overhanging surface 52 and engages the top surface 44 of the ridge 40 to further prevent or inhibit axial movement of the retainer clip 16 relative to the fuel rail cup 12 along the longitudinal axis 18. The fuel rail cup 12 has a second flat surface 54 that partially defines the second notch 50 and faces radially outward relative to the longitudinal axis 18. The second of the prongs 28 engages the second flat surface 54 to further prevent or inhibit rotation of the retainer clip 16 relative to the fuel rail cup 12 about the longitudinal axis 18. The first flat surface 48 and the second flat surface 54 may be oriented outward from the fuel rail cup at a substantially 180° angle relative to each other. Substantially 1800 may refer to any incremental value between exactly 180° and 15° from exactly 180°.

Figure 3:
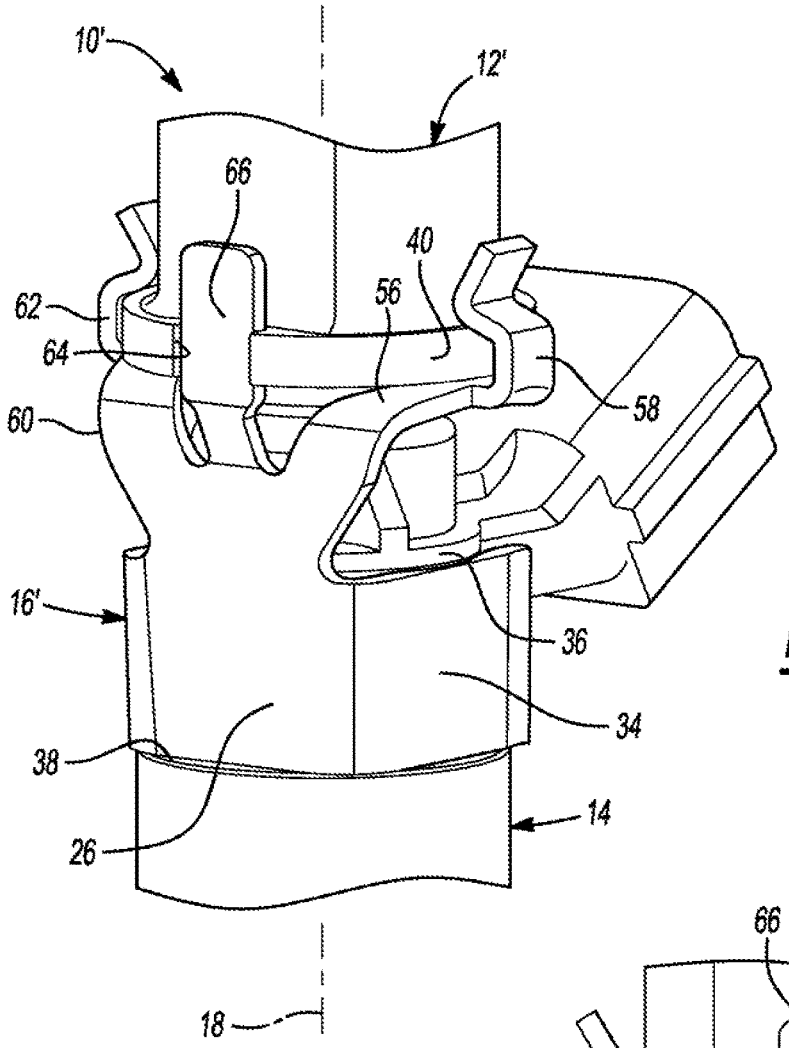
FIG. 3 is a partial isometric view of a second embodiment of the fuel delivery system that includes the a second embodiment of the fuel rail cup, the fuel injector, and a second embodiment of the clip that secures the fuel injector to the fuel rail cup.
Figure 4:
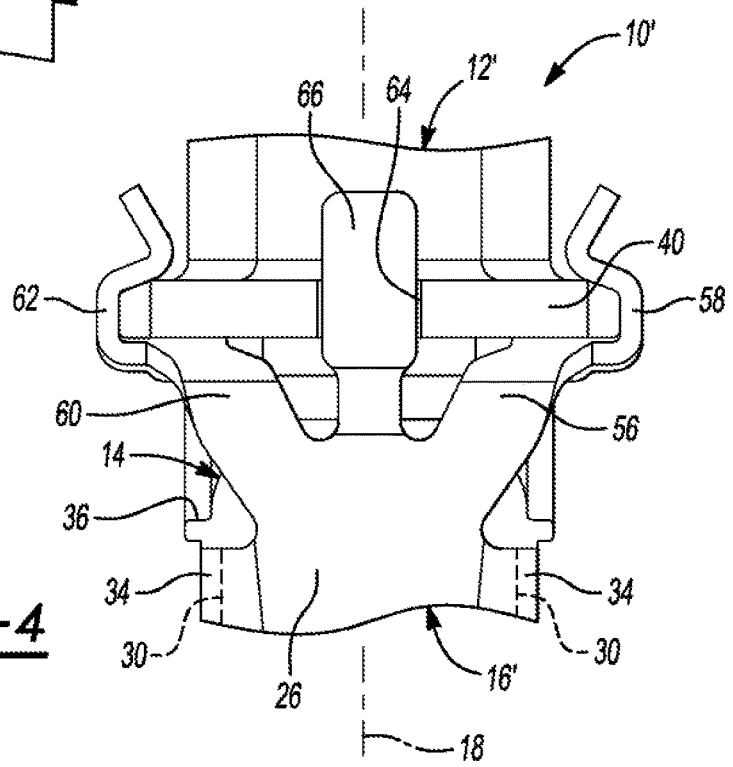
FIG. 4 is a partial rear view of the second embodiment of the fuel delivery system.

Referring to FIGS. 3 and 4, a second embodiment of a fuel delivery system 10' for an engine that includes a second embodiment of the fuel rail cup 12', a fuel injector 14, and a second embodiment of a retainer clip 16' that secures the fuel injector 14 to the fuel rail cup 12' is illustrated. The elements of the alternative embodiment depicted in FIGS. 3 and 4 that are common to elements of the embodiment depicted in FIGS. 1 and 2 will have the same structure and functionally as described with respect to the embodiment depicted in FIGS. 1 and 2 unless otherwise stated herein. For example, retainer clip 16' includes the central body 26 that defines the slot 32, the fuel injector 14 includes the upper ridge 36 and lower ridge 38 that prevent axial movement of the retainer clip 16' relative to the fuel injector 14, and the fuel rail cup 12' includes the ridge 40 that protrudes radially outward from a lower end of the fuel rail cup 12'.

The retainer clip 16' includes at least one prong that protrudes upward from the central body 26. The embodiment depicted in FIGS. 3 and 4 has three prongs. A first of the prongs 56 includes a first J-hook 58 that engages the ridge 40 on the fuel rail cup 12' to prevent or inhibit axial movement of the retainer clip 16' relative to the fuel rail cup 12' along the longitudinal axis 18. More specifically, the first J-hook 58 engages a top surface and a bottom surface of the ridge 40 to prevent or inhibit axial movement of the retainer clip 16' relative to the fuel rail cup 12' along the longitudinal axis 18. A second of the prongs 60 includes a second J-hook 62 that engages the ridge 40 on the fuel rail cup 12' to further prevent or inhibit axial movement of the retainer clip 16' relative to the fuel rail cup 12' along the longitudinal axis 18. More specifically, the second J-hook 62 engages a top surface and a bottom surface of the ridge 40 to further prevent or inhibit axial movement of the retainer clip 16' relative to the fuel rail cup 12' along the longitudinal axis 18. The second J-hook 62 may engage an opposing side of the ridge 40 relative to the first J-hook 58. The first prong 56 and second prong 60 may also be configured to generate a biasing force on the fuel rail cup 12 to absorb combustion energy that is translated to the fuel injector 14 during combustion within the engine.

The ridge 40 of the fuel rail cup 12' defines an exterior notch 64. A third of the prongs 66 extends upward into the notch 64 and engages the ridge 40 within the notch 64 such that rotation of the retainer clip 16' relative to the fuel rail cup 12' about the longitudinal axis 18 is inhibited. It should be understood that the designations of first, second, third, fourth etc. for prongs, J-hooks, plate, ridges, notches, surfaces, or any other component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A fuel delivery system for an engine comprising:

a fuel rail cup extending along a longitudinal axis and defining an opening that extends radially outward from the longitudinal axis, the fuel rail cup having a ridge that protrudes radially outward from a lower end of the fuel rail cup, the ridge having an upper surface and a lower surface, the ridge defining a notch along an outer radial periphery of the ridge, and the notch extending from the lower surface of the ridge to the upper surface of the ridge;

a fuel injector having an upper end that is disposed within the opening such that the cup and fuel injector are aligned along the longitudinal axis; and a retainer clip having a central body, at least one J-hook that protrudes upward from the central body, and a prong that protrudes upward from the central body, wherein the central body engages the fuel injector, wherein the at least one J-hook engages the lower surface of the ridge, wraps around the outer radial periphery of the ridge, and engages the upper surface of the ridge such that the clip inhibits axial movement of the fuel injector relative to the fuel rail cup along the longitudinal axis, and wherein the prong extends from below the lower surface of the ridge, through the notch defined by the ridge, and to a position that is above the upper surface of the ridge such that the prong engages the ridge within the notch and such that the clip inhibits rotation of the fuel injector relative to the fuel rail cup about the longitudinal axis.

2. The fuel delivery system of claim 1, wherein fuel injector has a pair of substantially parallel exterior surfaces, the central body defines a rectangular slot, and the clip engages the pair of substantially parallel exterior surfaces along the rectangular slot such that rotation of the clip relative to the fuel injector about the longitudinal axis is inhibited.

3. The fuel delivery system of claim 2, wherein the fuel injector has upper and lower ridges that protrude radially outward, the pair of substantially parallel exterior surfaces are disposed between upper and lower ridges, and the central body is disposed between the upper and lower ridges such that axial movement of the clip relative to the fuel injector along the longitudinal axis is inhibited.

4. The fuel delivery system of claim 1, wherein the at least one J-hook includes first and second J-hooks engaging the ridge to inhibit axial movement of the clip relative to the fuel rail cup along the longitudinal axis.

5. The fuel delivery system of claim 4, wherein the second J-hook engages an opposing side of the ridge relative to the first J-hook.

6. A fuel delivery system for an engine comprising:

a fuel rail cup extending along a longitudinal axis, defining an opening that extends radially outward from the longitudinal axis, and having a ridge that protrudes radially outward from a lower end of the fuel rail cup, the ridge having an upper surface and a lower surface, the ridge defining an exterior notch along an outer radial periphery of the ridge, and the notch extending from the lower surface of the ridge to the upper surface of the ridge;

a fuel injector having an upper end that is disposed within the opening such that the cup and fuel injector are aligned along the longitudinal axis; and a retainer clip having a central body, first and second J-hooks that protrude upward from the central body, and a prong that protrudes upward from the central body, wherein the central body is secured to the fuel injector such that axial movement of the clip and rotation of the clip relative to the fuel injector along and about the longitudinal axis, respectively, are inhibited, wherein the first and second J-hooks engage the lower surface of the ridge, wrap around the outer radial periphery of the ridge, and engage the upper surface of the the ridge to inhibit axial movement of the clip relative to the fuel rail cup along the longitudinal axis, and wherein the prong extends from below the lower surface of the ridge, through the notch defined by the ridge, and to a position that is above the upper surface of the ridge such that the prong engages the ridge within the notch to inhibit rotation of the clip relative to the fuel rail cup about the longitudinal axis.

7. The fuel delivery system of claim 6, wherein fuel injector has a pair of substantially parallel exterior surfaces, the central body defines a rectangular slot, and the clip engages the pair of substantially parallel exterior surfaces along the rectangular slot to inhibit rotation of the clip relative to the fuel injector about the longitudinal axis.

8. The fuel delivery system of claim 7, wherein, the fuel injector has upper and lower ridges that protrude radially outward, the pair of substantially parallel exterior surfaces are disposed between upper and lower ridges, and wherein the central body is disposed between the upper and lower ridges to inhibit axial movement of the clip relative to the fuel injector along the longitudinal axis.

9. The fuel delivery system of claim 6, wherein the second J-hook engages an opposing side of the ridge relative to the first J-hook.

10. A fuel injection system comprising:

a fuel rail cup defining an opening and having a ridge that protrudes radially outward from a lower end of the fuel rail cup, the ridge having an upper surface and a lower surface, the ridge defining a notch along an outer radial periphery of the ridge;

a fuel injector having an upper end that is disposed within the opening such that the cup and fuel injector are aligned along a longitudinal axis; and a retainer clip having a central body, a J-hook that protrudes upward from the central body, and a prong that protrudes upward from the central body, wherein the central body engages the fuel injector, wherein the J-hook engages the lower surface of the ridge, wraps around the outer radial periphery of the ridge, and engages the upper surface of the ridge such that the clip inhibits axial movement of the fuel injector relative to the fuel rail cup along the longitudinal axis, wherein the prong extends from below the lower surface of the ridge, through the notch defined by the ridge, and to a position that is above the upper surface of the ridge, and wherein the prong engages the ridge within the notch and such that the clip inhibits rotation of the fuel injector relative to the fuel rail cup about the longitudinal axis.

11. The fuel injection system of claim 10, wherein fuel injector has a pair of substantially parallel exterior surfaces, the central body defines a rectangular slot, and the clip engages the pair of substantially parallel exterior surfaces along the rectangular slot to inhibit rotation of the clip relative to the fuel injector about the longitudinal axis.

12. The fuel injection system of claim 11, wherein, the fuel injector has upper and lower ridges that protrude radially outward, the pair of substantially parallel exterior surfaces are disposed between upper and lower ridges, and wherein the central body is disposed between the upper and lower ridges to inhibit axial movement of the clip relative to the fuel injector along the longitudinal axis.

13. The fuel injection system of claim 10, wherein the retainer clip has a second J-hook that protrudes upward from the central body.

14. The fuel injection system of claim 13, wherein the second J-hook engages the lower surface of the ridge on the fuel rail cup, wraps around the outer radial periphery of the ridge on the fuel rail cup, and engages the upper surface of the ridge on the fuel rail cup such that the clip inhibits axial movement of the fuel injector relative to the fuel rail cup along the longitudinal axis.

15. The fuel injection system of claim 13, wherein the second J-hook engages an opposing side of the ridge relative to the J-hook.

* * * * *